US006478673B1

(12) United States Patent
Haynes

(10) Patent No.: US 6,478,673 B1
(45) Date of Patent: Nov. 12, 2002

(54) DIFFUSER FOR HEATING AND AIR CONDITIONING SYSTEMS

(75) Inventor: Gerald D. Haynes, Elkhart, IN (US)

(73) Assignee: Continental Industries, Inc., Elkhart, IN (US)

( * ) Notice: Subject to any disclaimer, the term of this patent is extended or adjusted under 35 U.S.C. 154(b) by 0 days.

(21) Appl. No.: 09/751,045

(22) Filed: Dec. 29, 2000

(51) Int. Cl.[7] ..... F24F 13/06
(52) U.S. Cl. ..... 454/292; 285/319; 285/360
(58) Field of Search ..... 454/292, 300; 285/319, 360, 376, 401

(56) References Cited

U.S. PATENT DOCUMENTS

| | | | | |
|---|---|---|---|---|
| 1,559,376 A | | 10/1925 | Riker | |
| 2,201,830 A | | 5/1940 | Hoffer et al. | |
| 2,308,262 A | | 1/1943 | Beil | |
| 2,369,119 A | * | 2/1945 | Dauphinee | 454/302 |
| 2,734,446 A | * | 2/1956 | O'Day | 454/292 |
| 2,861,510 A | * | 11/1958 | Wulle | 285/318 |
| 2,977,869 A | | 4/1961 | O'Day | |
| 3,110,242 A | | 11/1963 | O'Day | |
| 3,391,629 A | | 7/1968 | Snell | |
| 3,403,615 A | | 10/1968 | Dayus | |
| 3,426,668 A | | 2/1969 | Hofmeister et al. | |
| 3,618,986 A | | 11/1971 | Todavich | |
| 3,730,074 A | | 5/1973 | Helwig | |
| 3,777,650 A | | 12/1973 | Wenig | |
| 3,866,950 A | | 2/1975 | Skoch et al. | |
| 4,175,936 A | | 11/1979 | Lough et al. | |
| 4,297,525 A | | 10/1981 | Bowden, Jr. | |
| 4,473,000 A | | 9/1984 | Perkins | |
| 4,858,520 A | | 8/1989 | Porchnow et al. | |
| D315,790 S | | 3/1991 | Koessler | |
| 5,109,756 A | | 5/1992 | Barboza et al. | |
| 5,222,334 A | | 6/1993 | Hasty | |
| 5,410,782 A | | 5/1995 | Holyoake | |
| 5,658,196 A | | 8/1997 | Swaim | |
| 6,010,402 A | | 1/2000 | Schmidt | |

OTHER PUBLICATIONS

"SurfAir: SurfAire: A Hart & Cooley Exclusive", by Hart & Cooly, 2 pages, beginning on p. 39.
"High Volume Supply T–Bar Diffuser", by Hart & Cooley, 2 pages, beginning on p. 41.
"DIffuser & Return Grilles", by Hart & Cooley, 2 pages.
"S–Series Finishes", by Decor Grates Incorporated, 1 page.
"Climat Air" Climatic Air, *Automotive News*, Apr. 1968, 1 page.
"Series 10 V Multi–Louver Wall Register", by Lima Register Company, Oct. 1968, 1 page.
"Cieling Diffuser Installation Instruction Guide", 2 pages.

* cited by examiner

*Primary Examiner*—Harold Joyce
(74) *Attorney, Agent, or Firm*—Baker & Daniels

(57) ABSTRACT

A diffuser for a heating and air conditioning system includes a body portion and an adapter. The body portion includes a flange with a cylindrical portion. Flexible arms having projections are located about the cylindrical portion. Clamp guides are positioned about the cylindrical portion as well. The adapter includes multiple, different size cylindrical sections. One of the sections includes openings for receiving the projections on the arms to secure the adapter to the body. A tear-away strip is provided to remove unneeded sections of the adapter. Two attachment mechanisms are provided for securing the diffuser to a ceiling. The diffuser further includes a removable vane unit. The vane unit includes multiple projections for engaging prongs on the base to secure the vane unit to the base. A ribs on the projections contact the prongs to limit vibrations. The diffuser baffles include a collar for reducing vibrations.

29 Claims, 5 Drawing Sheets

DIFFUSER FOR HEATING AND AIR CONDITIONING SYSTEMS

BACKGROUND OF THE INVENTION

1. Field of the Invention

The present invention relates to an air diffuser for heating and air conditioning systems and, in particular, to an air diffuser including an adapter for attaching the diffuser to duct work of varying sizes.

2. Discussion of the Prior Art

Numerous types of air diffusers for heating and air conditioning systems are known in the prior art. Such diffusers are used to deflect the flow of air from the heating and air conditioning duct such that it is not all directed to one location. Examples of various diffusers are shown in U.S. Pat. No. 2,977,869 to O'Day, U.S. Pat. No. 3,110,242 to O'Day, U.S. Pat. No. 3,866,950 to Shock et al., U.S. Pat. No. 4,473,000 to Perkins, U.S. Pat. No. 5,109,756 to Barboza et al., and U.S. Pat. No. 5,410,782 to Holyoake.

SUMMARY OF THE INVENTION

In one embodiment of the present invention, an air diffuser for a heating and air conditioning system includes a flange, a first cylindrical portion connected to the flange, a projection connected to the first cylindrical portion, an adapter and an opening in the adapter for receiving the projection. A flexible arm may be connected to the cylindrical portion and the projection may be connected to the arm. The adapter may include a second cylindrical portion that fits within the first cylindrical portion. Insertion of the second cylindrical portion into the first cylindrical portion causes movement of the projection. The opening may be located in the second cylindrical portion. The adapter may be rotated within the first cylindrical portion to align the opening and the projection. Further rotation of the adapter disengages the projection from the opening. The projection prevents movement of the adapter relative to the first cylindrical portion in at least one direction when the projection is located in the opening. In one embodiment, the projection includes a camming surface and further rotation of the adapter in one direction causes the camming surface to ride along the periphery of the opening and disengage the projection from the opening.

In another embodiment of the invention, a diffuser includes a body, a pair of prongs extending from the body, a vane unit and a projection extending from the vane unit. The projection includes an enlarged portion and a rib on the enlarged portion. The projection fits within a space between the prongs. Inserting the projection into the space between the prongs causes the prongs to move away from each other. The prongs are biased toward the projection when the projection is located between the prongs.

In another embodiment of the invention, a diffuser includes a first portion for connection to a duct, a plurality of baffles, a projection connected to the baffles and extending through the first portion and a collar located about the projection. The collar spaces the baffles from the first portion.

In yet another embodiment of the invention, a diffuser includes a first portion, a clamp for securing a duct to the first portion and a guide for locating the clamp. The guide includes a plurality of ridges extending from the cylindrical portion.

In another embodiment of the invention, a diffuser includes a flange, a first portion for connection to a duct, the first portion connected to the flange, a plurality of fins connected to the first portion and a seal located adjacent the fins. The fins include notches and the seal rests in the notches. The seal is a compressible member.

In another embodiment of the invention, a diffuser includes a first portion, an adapter, first means for preventing vertical movement of the adapter relative to the first portion, and second means for preventing rotation of the adapter relative to the first portion in at least one direction.

Other features of the present invention will be apparent to those skilled in the art from the following detailed description of the preferred embodiments and accompanying drawings.

DETAILED DESCRIPTION OF THE PREFERRED EMBODIMENT

Figure 1:
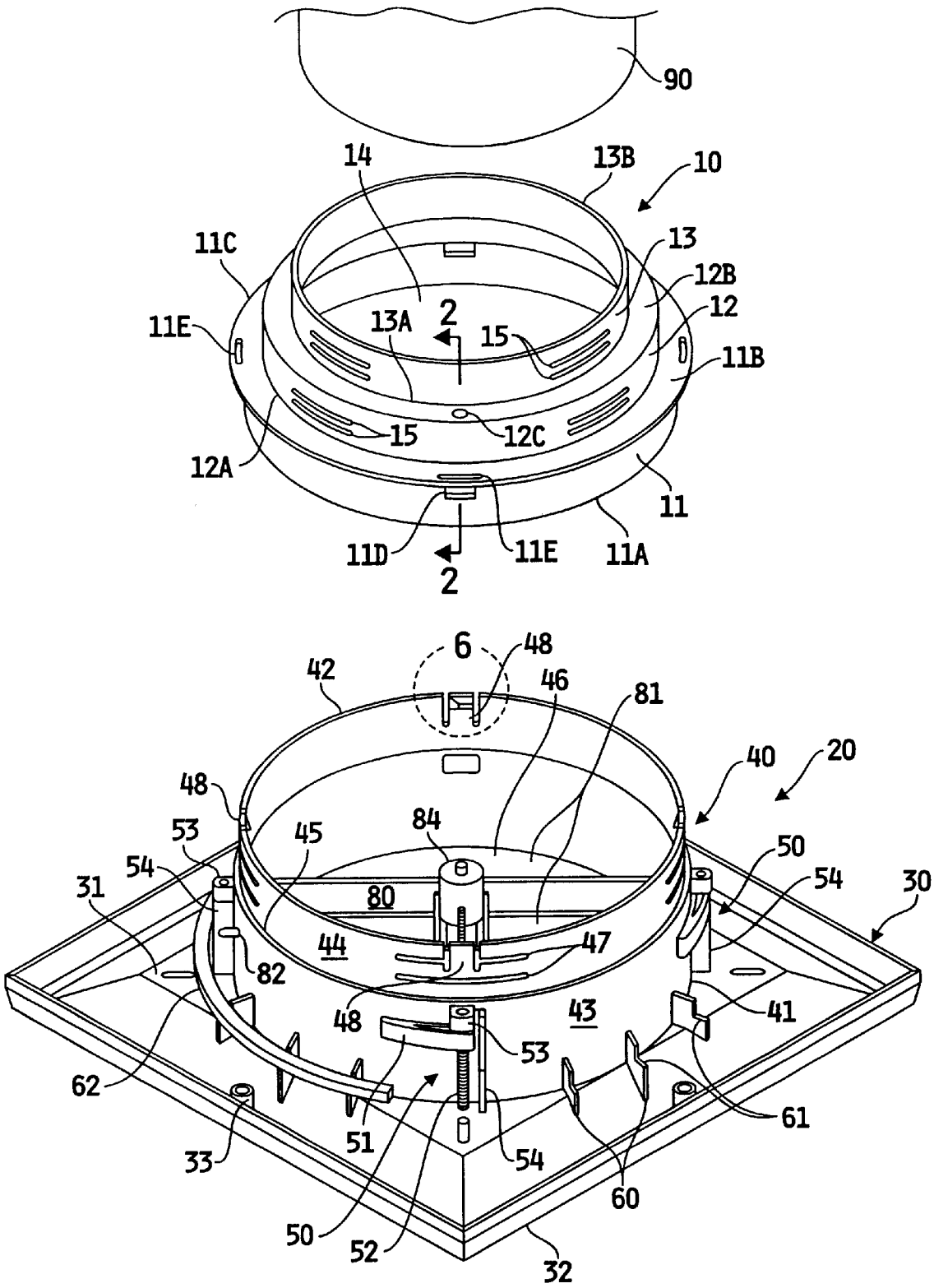
FIG. 1 is an exploded perspective view of an air diffuser according to one embodiment of the present invention.
Figure 2:
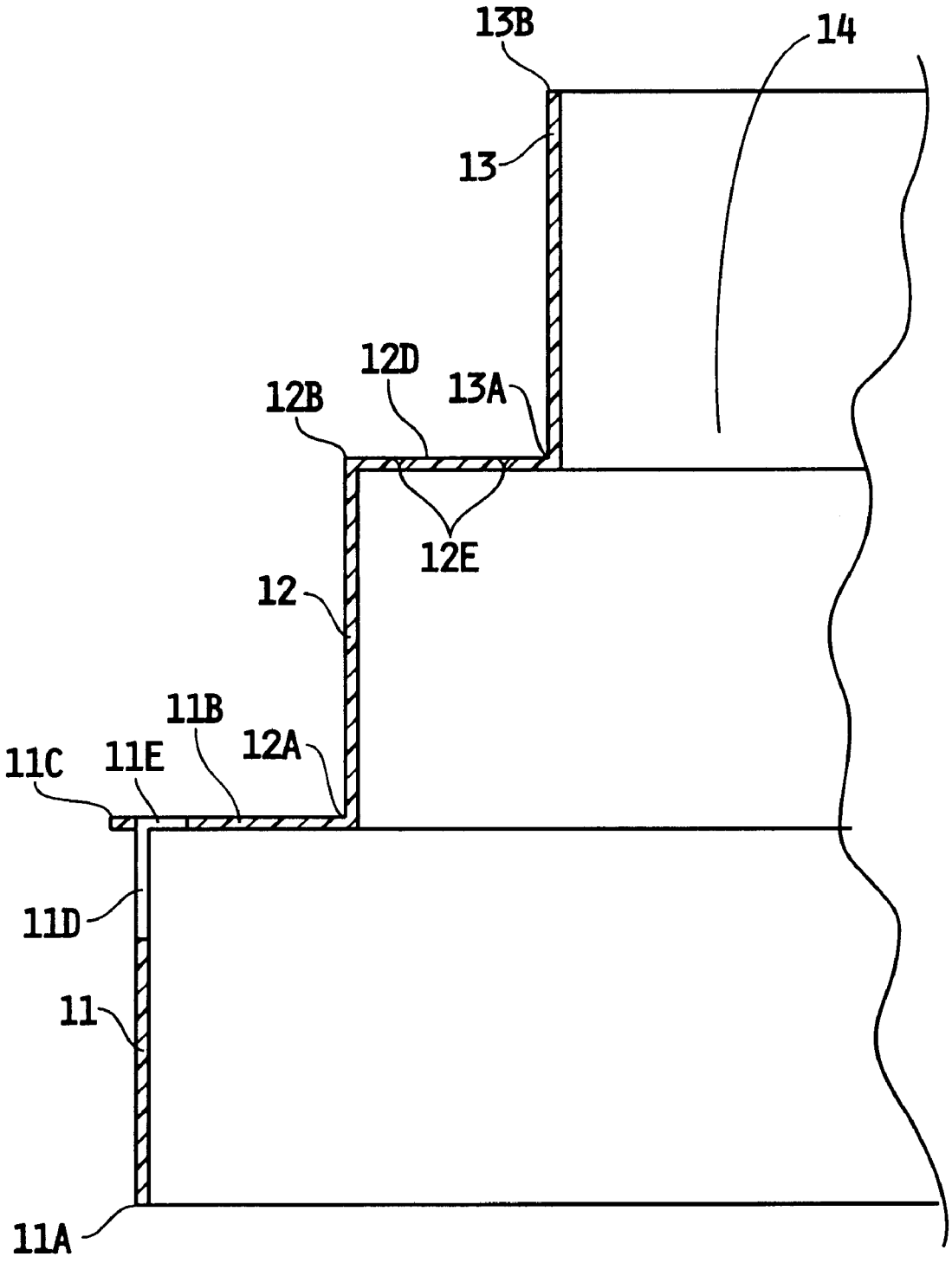
FIG. 2 is a partial sectional view taken along line 2—2 in FIG. 1.

FIG. 1 is an exploded perspective view of an air diffuser according to one embodiment of the present invention. The diffuser generally includes an adapter 10 and a base 20. Adapter 10 includes a first cylindrical portion 11, a second cylindrical portion 12, and a third cylindrical portion 13. Cylindrical portion 12 has a smaller diameter than cylindrical portion 11 and cylindrical portion 13 has a smaller diameter than cylindrical portions 11 and 12. Cylindrical portion 11 includes a first end 11A and an opposite, second end 11B. A flange 11C extends from second end 11B. Cylindrical portion 11 further includes a plurality of openings 11D located around the perimeter of cylindrical portion 11. A plurality of openings 11E is located around the perimeter of second end 11B and communicates with openings 11D. Second cylindrical portion 12 includes a first end 12A secured to second end 11B of cylindrical portion 11 and a second, opposite end 12B. A dimple 12C is located in second end 12B. Dimple 12C is adapted to permit removal of tear-away strip 12D defined by indentations or scores 12E (FIGS. 2 and 3), as described below. Third cylindrical portion 13 includes a first end 13A attached to second end 12B of cylindrical portion 12 and a second, opposite end 13B. An opening 14 extends through cylindrical portions 11, 12, and 13. A plurality of clamp guides 15 are spaced about cylindrical portions 12 and 13. In the embodiment shown, clamp guides 15 are a plurality of ridges formed on cylindrical portions 12 and 13.

Figure 4:
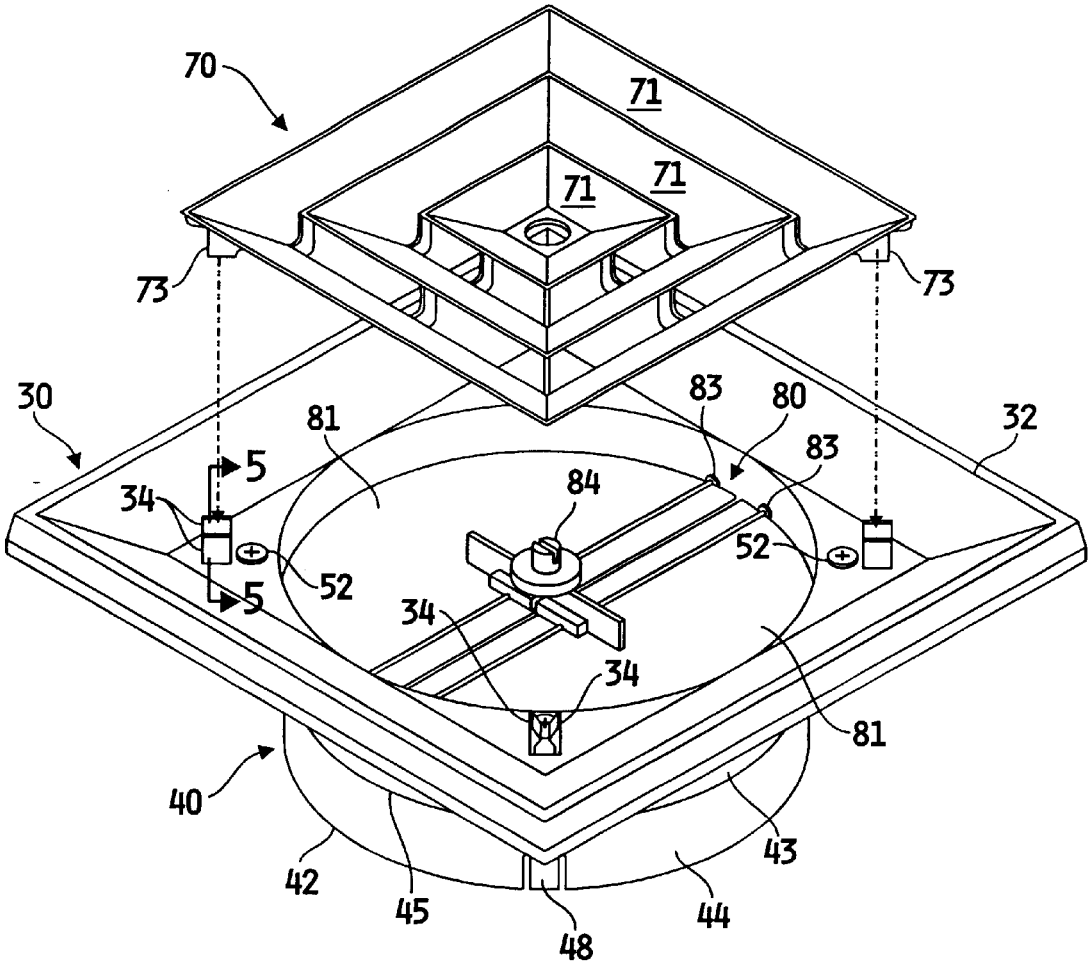
FIG. 4 is an exploded perspective view of the opposite side of the diffuser shown in FIG. 1.
Figure 5:
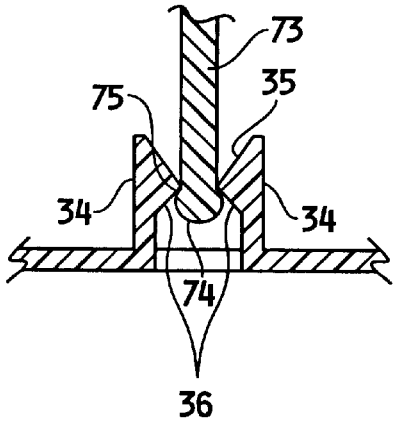
FIG. 5 is a partial, sectional view showing engagement of a vane unit that is a component of the diffuser shown in FIG. 1 with the base of the diffuser.
Figure 7:
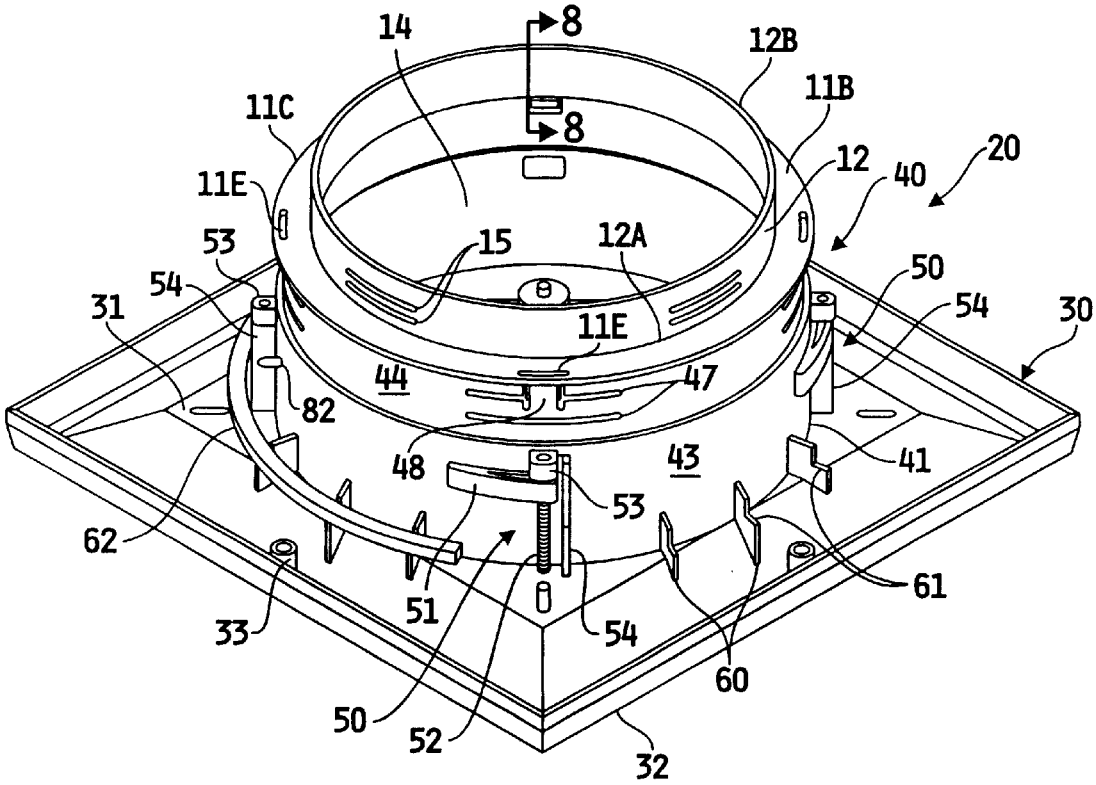
FIG. 7 shows the adapter with a portion removed, secured to the base.
Figure 9:
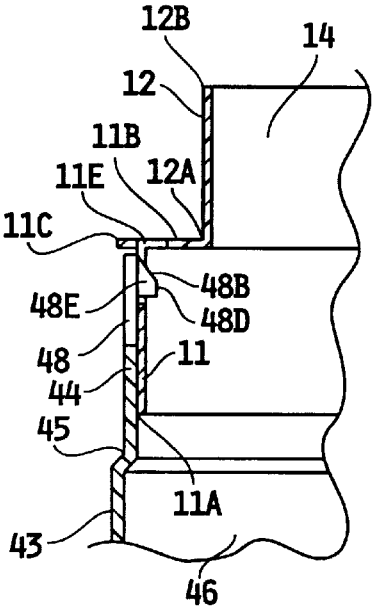
FIGS. 8 and 9 are sectional views taken along line 8—8 in FIG. 7 showing the manner in which the adapter is secured to the base.
Figure 8:
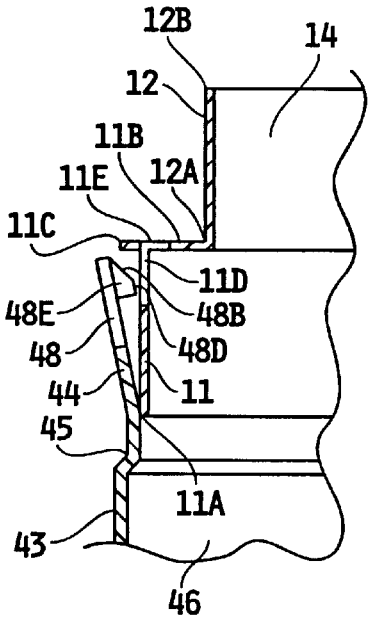

Base 20 generally includes a flange 30, a cylindrical portion 40, and locking assemblies 50. Flange 30, in the embodiment shown, is a generally square member including a first side 31, a second side 32, a plurality of mounting openings 33, and a plurality of prongs 34 (FIGS. 4 and 5) extending from second side 32. Prongs 34 each include a first inclined surface 35 and a second oppositely inclined surface 36.

Figure 6:
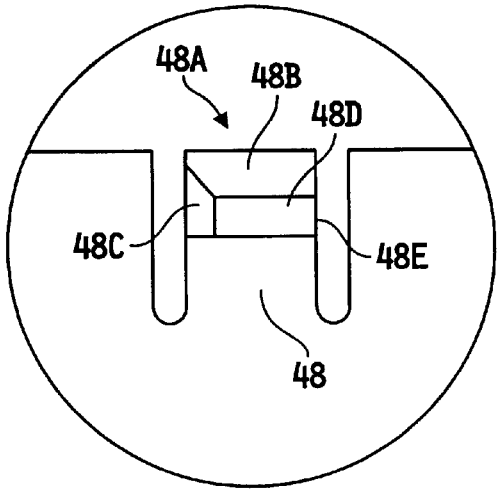
FIG. 6 is a detailed view of the area shown in circle 6 in FIG. 1.

Cylindrical portion 40 includes a first end 41 connected to flange 30 and a second end 42. Cylindrical portion 40 includes a first section 43 delineated from a second diameter section 44 by a ridge 45. Cylindrical portion 40 has a central opening 46. A plurality of clamp guides 47 is formed around section 44. In the embodiment shown, clamp guides 47 are a plurality of ridges formed on section 44. A plurality of arms 48 (FIGS. 1 and 6) are located around the perimeter of section 44 and are used to secure adapter 10 to base 20, as described below. Each arm 48 includes a projection 48A having a first sloped or camming surface 48B adjacent the top portion thereof and a second sloped or camming surface 48C adjacent one side thereof. Surfaces 48B and 48C extend inwardly toward opening 46 of cylindrical portion 40 and terminate in a face 48D. Side 48E of projection 48A opposite surface 48C is a generally flat surface.

Locking assemblies 50 generally include dogs 51, screws 52, studs 53, and stops 54. Screws 52 extend through flange 30, through dogs 51 and into studs 53. Dogs 51 are connected to screws 52 such that rotation of screws 52 causes rotation of dogs 51. Movement of dogs 51 is limited in one direction by section 43 of cylindrical portion 40 and in the other direction by stops 54.

A plurality of projections 60 having notches 61 are connected to first section 43 of cylindrical portion 40 and to first side 31 of flange 30. A seal 62 (a portion of which is shown in FIG. 1) rests in notches 61. Seal 62 is preferably a compressible foam or rubber member.

Vane unit 70 (FIGS. 4 and 5) includes a plurality of vanes 71 for diverting airflow out of the diffuser. Vane unit 70 further includes an opening 72 for operating the dampers of the diffuser, as described below. Vane unit 70 also includes a plurality of projections 73 for securing vane unit 72 of flange 30 as described below. Each projection 73 includes an enlarged portion 74 having a rib 75.

Damper mechanism 80 (FIGS. 1 and 4) includes baffles 81 secured to cylindrical portion 40 by a projection 82 extending through cylindrical portion 40. A standoff or collar 83 is formed on projection 82 to space it from section 43 of cylindrical portion 40. A drive mechanism 84 is positioned in line with opening 72 on vane unit 70 to permit adjustment of baffles 81.

To install the diffuser, a hole is cut in the ceiling, wall or other surface to which the diffuser is to be secured. A duct 90 is then extended through the opening and connected to the diffuser. Depending upon the size of duct 90, adapter 10 may or may not be needed. If the adapter is not to be used, duct 90 is positioned around second section 44 of cylindrical portion 40 and secured with a tie-wrap or band clamp. The wrap or clamp is positioned about duct 90 between guides 47 and tightened to secure duct 90 to cylindrical portion 40. Note that guides 47 (or 15 if adapter 10 is used) also grip duct 90 to help hold duct 90 in place.

If adapter 10 is to be used, cylindrical portion 11 is positioned over second section 44 of cylindrical portion 40. Adapter 10 is then lowered into cylindrical portion 40. As this occurs, first end 11A of cylindrical portion 11 pushes against surface 48B of projection 48A causing arm 48 to flex away from the center of opening 46. This continues until cylindrical portion 11 is inserted far enough such that face 48D comes in contact with the outer surface of cylindrical portion 11. Adapter 10 is further inserted until flange 11C contacts end 42A of section 42. Adapter 10 is then rotated, in the embodiment shown, in a counter-clockwise direction. When projections 48A are aligned with openings 11D, they will snap inwardly into place to secure adapter 10. Rotation can continue until the edges of openings 11D contact sides 48E of projections 48A.

Note also that if openings 11D are aligned with projections 48 when adapter 10 is inserted, arms 48A will move into position so that the projections 48A are engaged with openings 11D upon full insertion of adapter 10 without the need to rotate adapter 10. To remove adapter 10, adapter 10 may be rotated in the opposite direction, clockwise in the embodiment shown, such that an edge of opening 11D contacts surface 48C of projection 48A. Continued rotation causes arm 48 to move outwardly and release projection 48A from opening 11D. Adapter 10 may then be removed.

Figure 3:
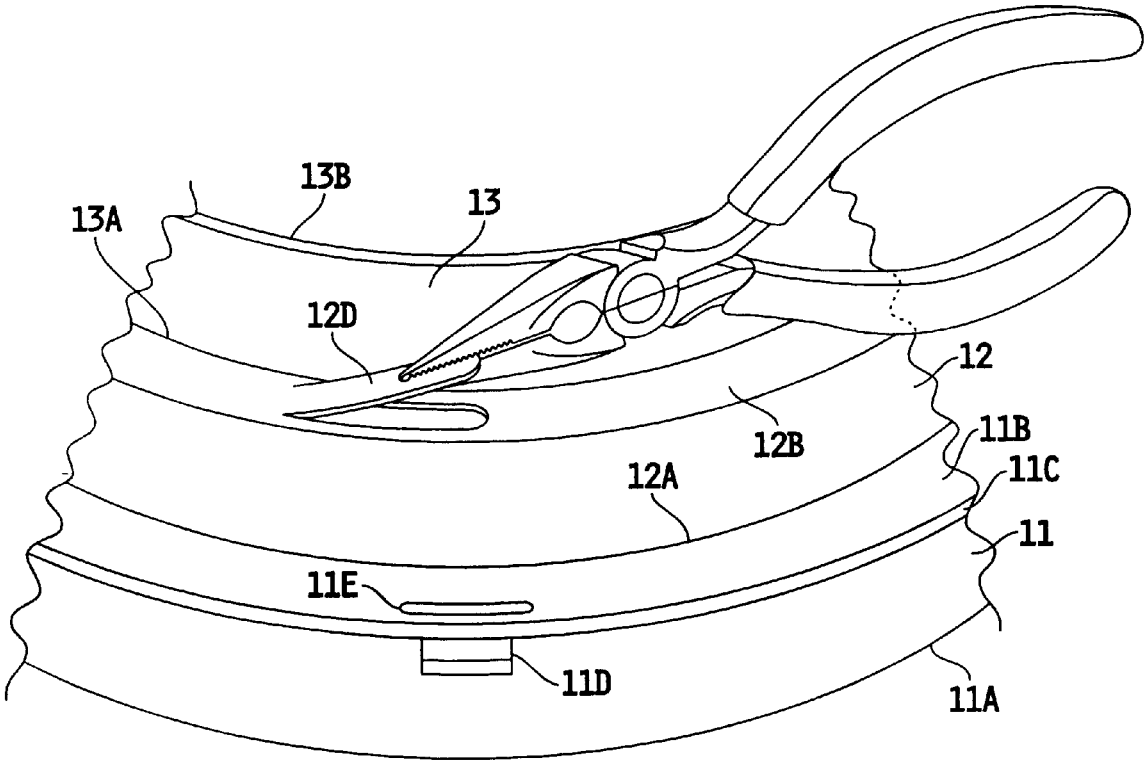
FIG. 3 is a partial view of an adapter that is a component of the diffuser shown in FIG. 1, illustrating removal of a portion of the adapter.

Once adapter 10 is fully inserted and engaged, duct 90 may be attached directly to cylindrical portion 13 by utilizing a band clamp or tie wrap in the manner described above. Alternatively, if an intermediate-sized duct is to be used by attaching it to cylindrical portion 12, pliers or another tool are used to puncture dimple 12C and grip tear-away strip 12D (FIG. 3). The pliers are then used to remove tear-away strip 12D from the remainder of adapter 10, thereby separating cylindrical portion 13 from cylindrical portion 12. Duct 90 is then secured to cylindrical portion 12 in the manner described above.

Once duct 90 has been secured to either cylindrical portion 40 or adapter 10, duct 90 and the diffuser are pushed toward the ceiling until flange 30 abuts the ceiling. Screws 52 are then rotated to move dogs 51 into contact with stops 54. Further rotation causes dogs 51 to travel downwardly along screw 52 toward flange 30, ultimately clamping the ceiling between dogs 51 and flange 30. Note that as this occurs, the ceiling will compress seal 62, thereby reducing the possibility that air from above the ceiling will escape around adapter 10 or cylindrical portion 40, will escape between the ceiling and flange 30 and into the room. Note that screws or similar fasteners can be inserted through opening 33 as an alternative to or in combination with use of dogs 51 to secure the diffuser to the ceiling.

To secure vane unit 70 to flange 30, projections 73 are positioned adjacent prongs 34 and inserted so as to ride against surfaces 35 and cause prongs 34 to flex outwardly. This continues until rib 75 is positioned adjacent surface 34 as shown. Because prongs 34 are flexible, this biases prongs 34 inwardly and holds vane unit 70 in place. Contact between prongs 34 and ribs 75 reduces vibrations of vane unit 70. Vane unit 70 may be removed by simply pulling on vane unit 70 to disengage projections 73 from prongs 34. Note that various interchangeable vane units having different vane configurations may be provided for use with the diffuser.

Baffles 81 of damper 80 may be adjusted by inserting a screwdriver or similar tool through opening 72 in vane unit 70 and operating drive mechanism 84. Collar or standoff 83 provides clearance for baffles 81 about the interior of cylindrical portion 40 and, because of their close proximity to the interior of cylindrical portion 40, reduce vibrations.

Although the present invention has been shown and described in detail, the same is for purposes of example only and not intended to be a limitation on the invention. Numerous changes to the embodiments disclosed will be apparent to those skilled in the art. Accordingly, the scope of the present invention is to be limited only by the claims appended hereto.

What is claimed is:

1. A diffuser, including:

a flange;

a first cylindrical portion connected to the flange;

a projection connected to the cylindrical portion;

an adapter; and an opening in the adapter for receiving the projection, wherein a portion of the adapter fits within the first cylindrical portion and can be rotated until the projection engages the opening, and further rotation of the adapter in one direction disengages the projection from the opening.

2. A diffuser according to claim 1, further including a flexible arm connected to the cylindrical portion and wherein the projection is connected to the arm.

3. A diffuser according to claim 1, wherein the adapter includes a second cylindrical portion and the opening is located in the second cylindrical portion.

4. A diffuser according to claim 3, wherein the second cylindrical portion fits within the first cylindrical portion.

5. A diffuser according to claim 3, wherein insertion of the second cylindrical portion into the first cylindrical portion causes movement of the projection.

6. A diffuser according to claim 3, wherein insertion of the second cylindrical portion into the first cylindrical portion causes movement of the projection away from the center of the first cylindrical portion.

7. A diffuser according to claim 1, wherein the projection moves toward the center of the first cylindrical portion when the opening in the adapter is aligned with the projection.

8. A diffuser according to claim 1, wherein the adapter may be rotated within the first cylindrical portion to align the opening and the projection.

9. A diffuser according to claim 1, wherein the projection prevents movement of the adapter relative to the first cylindrical portion in at least one direction when the projection is located in the opening.

10. A diffuser according to claim 1, wherein the projection prevents rotation of the adapter relative to the first cylindrical portion in at least one direction when the projection is located in the opening.

11. A diffuser according to claim 1, wherein the projection prevents vertical movement of the adapter relative to the first cylindrical portion when the projection is located in the opening.

12. A diffuser according to claim 1, wherein the projection includes a camming surface and further rotation of the adapter in one direction causes the camming surface to ride along the periphery of the opening and disengage the projection from the opening.

13. A diffuser according to claim 1, wherein the projection prevents rotation of the adapter in one direction when the projection is located in the opening.

14. A diffuser according to claim 1, wherein the adapter includes at least two cylindrical portions.

15. A diffuser according to claim 14, wherein the cylindrical portions of the adapter are different sizes.

16. A diffuser, including:

a flange;

a cylindrical portion extending from the flange;

a vane unit connected to the flange;

a flexible arm connected to the cylindrical portion, the arm including a projection having a first camming surface and a second camming surface;

an adapter having a second portion that fits within the cylindrical portion; and an opening in the adapter for receiving the projection.

17. A diffuser according to claim 16, wherein the projection prevents vertical movement of the adapter relative to the cylindrical portion.

18. A diffuser according to claim 16, wherein the projection prevents rotation of the adapter with respect to the cylindrical portion in at least one direction.

19. A diffuser according to claim 16, further including a dog for securing the diffuser to a ceiling.

20. A diffuser according to claim 19, further including a plurality of openings for receiving fasteners to secure the diffuser to a ceiling.

21. A diffuser according to claim 16, further including a clamp for securing the first portion to a duct and a plurality of clamp guides connected to the first portion.

22. A diffuser for venting air from a heating or air conditioning system, comprising: a flange; a first cylindrical portion connected to the flange; an adapter for connecting said flange and said first cylindrical portion to a duct, said adapter including a second cylindrical portion; and a securing mechanism for securing said adapter to said first cylindrical portion, said securing mechanism engaged by inserting one of said cylindrical portions into the other and rotating one of the cylindrical portions in a first direction relative to the other until a positive engagement is achieved, and whereby said securing mechanism may be disengaged by rotating one of said cylinders in an opposite direction to release said positive engagement allowing said first and second cylinders to be freely removed from one another.

23. A diffuser according to claim 22, wherein said securing mechanism includes a projection on said first cylindrical portion and an opening in said second cylindrical portion for receiving said projection.

24. A diffuser according to claim 23, said securing mechanism further including a flexible arm connected to said first cylindrical portion, said projection attached to said arm.

25. A diffuser according to claim 23, wherein said projection has a first camming surface and a second camming surface.

26. A diffuser for venting air from a heating or air conditioning system, comprising: a flange; a first cylindrical portion connected to the flange; an adapter for connecting said flange and said first cylindrical portion to a duct, said adapter including a second cylindrical portion; and means for connecting said adapter to said first cylindrical portion, said connecting means engaged by inserting one of said cylindrical portions into the other and rotating one of the cylindrical portions in a first direction relative to the other until a positive engagement is achieved, and whereby said connecting means may be disengaged by rotating one of said cylinders in an opposite direction to release said positive engagement allowing said first and second cylinders to be freely removed from one another.

27. A diffuser according to claim 26, wherein said connecting means includes a projection on said first cylindrical portion and an opening in said second cylindrical portion for receiving said projection.

28. A diffuser according to claim 27, said connecting means further including a flexible arm connected to said first cylindrical portion, said projection attached to said arm.

29. A diffuser according to claim 27, wherein said projection has a first camming surface and a second camming surface.

* * * * *